US009410699B2

(12) United States Patent
Satoh et al.

(10) Patent No.: US 9,410,699 B2
(45) Date of Patent: Aug. 9, 2016

(54) COMBUSTION HEATER

(71) Applicants: Kimiyoshi Satoh, Tokyo (JP); Soichiro Kato, Tokyo (JP); Shusaku Yamasaki, Tokyo (JP); Kazuo Miyoshi, Tokyo (JP)

(72) Inventors: Kimiyoshi Satoh, Tokyo (JP); Soichiro Kato, Tokyo (JP); Shusaku Yamasaki, Tokyo (JP); Kazuo Miyoshi, Tokyo (JP)

(73) Assignee: IHI CORPORATION (JP)

( * ) Notice: Subject to any disclaimer, the term of this patent is extended or adjusted under 35 U.S.C. 154(b) by 320 days.

(21) Appl. No.: 14/149,120

(22) Filed: Jan. 7, 2014

(65) Prior Publication Data

US 2014/0116424 A1 May 1, 2014

Related U.S. Application Data

(63) Continuation of application No. PCT/JP2012/068826, filed on Jul. 25, 2012.

(30) Foreign Application Priority Data

Jul. 27, 2011 (JP) ..... 2011-163867

(51) Int. Cl.

| | |
|---|---|
| ***F23D 14/12*** | (2006.01) |
| ***F23D 14/02*** | (2006.01) |
| ***F23D 14/74*** | (2006.01) |
| ***F23D 14/58*** | (2006.01) |

(Continued)

(52) U.S. Cl.

CPC ..... *F23D 14/125* (2013.01); *F23C 3/006* (2013.01); *F23D 14/02* (2013.01); *F23D 14/145* (2013.01); *F23D 14/18* (2013.01); *F23D 14/58* (2013.01); *F23D 14/74* (2013.01)

(58) Field of Classification Search

CPC ..... F23D 14/02; F23D 14/74; F23D 14/58; F23D 14/145; F23D 14/18; F23D 14/125; F23C 3/006

See application file for complete search history.

(56) References Cited

U.S. PATENT DOCUMENTS

| | | | | |
|---|---|---|---|---|
| 2006/0003279 | A1 | 1/2006 | Best | 431/328 |
| 2006/0292510 | A1 | 12/2006 | Krauklis et al. | 431/326 |

FOREIGN PATENT DOCUMENTS

| | | | |
|---|---|---|---|
| CN | 201028527 | Y | 2/2008 |
| CN | 201285044 | Y | 8/2009 |

(Continued)

OTHER PUBLICATIONS

Chinese Office Action, dated Nov. 11, 2015, issued in corresponding Chinese Patent Application No. 201280036562.0. Partial English translation of Search Report. Total 8 pages.

(Continued)

*Primary Examiner* — Alfred Basichas

(74) *Attorney, Agent, or Firm* — Ostrolenk Faber LLP

(57) ABSTRACT

A combustion heater (110) that is provided with a heating plate (126); a placement plate (120) disposed opposite the heating plate; an outer wall (122) provided around the outer circumference of the heating plate and the placement plate; a partitioning plate (124) that is disposed opposite the heating plate and the placement plate inside a space enclosed by the heating plate, the placement plate, and the outer wall, that forms a lead-in portion (134) by a gap with the placement plate, and that forms a lead-out portion (142) by a gap with the heating plate; a linking portion (136) that links the lead-in portion and the lead-out portion; a combustion chamber (138) that combusts fuel gas at the lead-out portion near the linking portion; and a flame-stabilization portion (140) that is provided in the combustion chamber and that maintains the combustion of the fuel gas in the combustion chamber.

8 Claims, 6 Drawing Sheets

(51) Int. Cl.

| | |
|---|---|
| ***F23D 14/14*** | (2006.01) |
| ***F23D 14/18*** | (2006.01) |
| ***F23C 3/00*** | (2006.01) |

(56) References Cited

FOREIGN PATENT DOCUMENTS

| | | | | |
|---|---|---|---|---|
| CN | 101595343 | A | | 12/2009 |
| EP | 1225393 | A2 | | 7/2002 |
| FR | 2791419 | A1 | | 9/2000 |
| GB | 2347362 | | * | 6/2000 |
| JP | 54-016827 | | | 6/1979 |
| JP | 2005-076973 | | | 3/2005 |
| JP | 2005-076974 | | | 3/2005 |
| JP | 2007-093180 | | | 4/2007 |
| JP | 2007-155216 | | | 6/2007 |
| JP | 2007-155221 | | | 6/2007 |
| JP | 4494346 | | | 6/2010 |
| JP | 2010-534313 | | | 11/2010 |
| WO | WO 2009/014980 | A2 | | 1/2009 |

OTHER PUBLICATIONS

Office Action dated Mar. 20, 2014 issued in corresponding Taiwan Patent Application No. 101126756 with English translation.

International Search Report and Written Opinion mailed Oct. 16, 2012 in corresponding PCT International Application No. PCT/JP2012/068826.

European Search Report, dated Feb. 18, 2015, issued in corresponding European Patent Application No. 12817695.5. Total 6 pages.

* cited by examiner

COMBUSTION HEATER

Priority is claimed on Japanese Patent Application No. 2011-163867, filed Jul. 27, 2011, the content of which is incorporated herein by reference.

This application is a Continuation of International Application No. PCT/JP2012/068826, filed on Jul. 25, 2012, claiming priority based on Japanese Patent Application No. 2011-163867, filed Jul. 27, 2011, the content of which is incorporated herein by reference in their entity.

TECHNICAL FIELD

The present invention relates to a combustion heater that heats an object to be fired by burning fuel.

BACKGROUND ART

Gas heaters that heat a radiating body with combustion heat produced by the burning of fuel gas and that heat industrial materials and food and the like with radiating heat from the radiation surface of a radiating body are widely gaining popularity.

Also, technology has been proposed that increases the thermal efficiency by preheating the fuel gas prior to combustion with the heat of exhaust gas (For example, Patent Document 1). In Patent Document 1, a constitution is disclosed that is provided with a combustion chamber that comes into contact with the outer wall that is disposed around the outer circumference of the main body, a lead-in portion that guides fuel gas from the center of the main body to the combustion chamber, and a lead-out portion that concentrates post-combustion exhaust gas at the center of the main body and guides it to outside the body, with the lead-in portion and the lead-out portion made adjacent to each other by having a partitioning plate serve as a boundary.

PRIOR ART DOCUMENT

Patent Document

[PATENT DOCUMENT 1] Japanese Patent No. 4494346

DISCLOSURE OF THE INVENTION

Problems to be Solved by the Invention

For example, in the combustion heater such as that of the constitution of Patent Document 1 given above, in the combustion chamber, by causing the fuel gas that flows in from the lead-in portion to collide with the outer wall and to be retained, the flame is stabilized. In this case, the combustion chamber must be brought close to the outer wall.

Also, for example, if the combustion chamber can be spaced apart from the outer wall, it is possible to inhibit heat dissipation from the combustion chamber to outside the combustion heater via the outer wall, and so it is possible to expect a further improvement in the thermal efficiency.

In this way, if the degree of freedom in the arrangement of the combustion chamber increases, since the possibility of a further increase in efficiency broadens, an improvement in the design freedom is sought in the arrangement of the combustion chamber of the combustion heater.

The present invention has as its object to provide a combustion heater that enables an increase in the freedom of arrangement of the combustion chamber.

Means for Solving the Problems

The combustion heater according to the first aspect of the present invention is provided with a heating plate; a placement plate disposed opposite the heating plate; an outer wall provided around the outer circumference of the heating plate and the placement plate; a partitioning plate disposed so as to face the heating plate and the placement plate inside a space enclosed by the heating plate, the placement plate, and the outer wall, that forms a lead-in portion by a gap with the placement plate, and that forms a lead-out portion by a gap with the heating plate; a linking portion that links the lead-in portion and the lead-out portion; a combustion chamber that combusts fuel gas at the lead-out portion near the linking portion; and a flame-stabilization portion that is provided in the combustion chamber and that maintains the combustion of the fuel gas in the combustion chamber.

In the combustion heater according to the second aspect of the present invention, the linking portion in the aforementioned first aspect may be one or a plurality of through-holes provided in the partitioning plate.

In the combustion heater according to the third aspect of the present invention, the flame-stabilization portion in the aforementioned first aspect or second aspect may include a concavity that is provided at a position of the heating plate opposite the linking portion.

In the combustion heater according to the fourth aspect of the present invention, the flame-stabilization portion in any one of the aforementioned first to third aspects may include a catalyst.

In the combustion heater according to the fifth aspect of the present invention, the flame-stabilization portion in any one of the aforementioned first to fourth aspects may include a porous body.

Effects of the Invention

According to the present invention, increasing the degree of freedom of arrangement of the combustion chamber becomes possible.

BEST MODE FOR CARRYING OUT THE INVENTION

Figure 1:
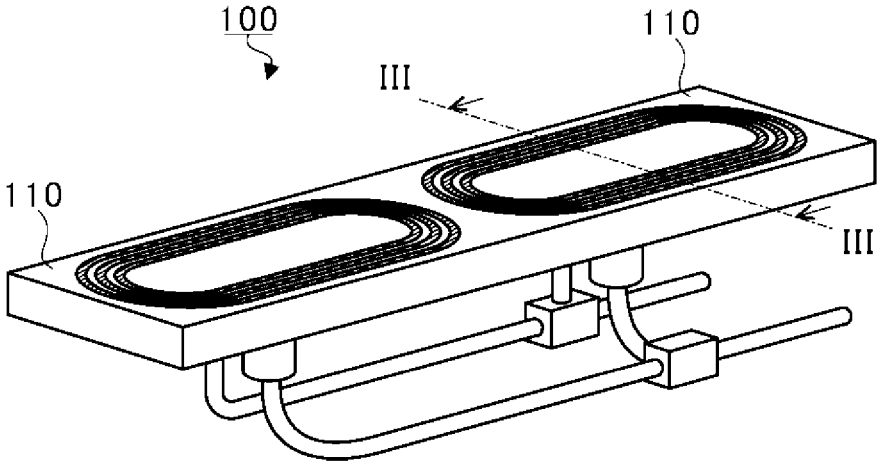
FIG. 1 is a perspective view that shows an example of the external appearance of the combustion heating system in the first embodiment of the present invention.

Hereinbelow, the preferred embodiments of the present invention shall be described with reference to the appended drawings. Note that in the following drawings, the scale of each member shall be suitably changed in order to make each member a recognizable size. Also, in the description and the drawings, by giving the same reference numerals to those elements having essentially the same function and constitution, overlapping explanations shall be omitted, and the illustration of elements with no direct connection to the present invention shall be omitted.

First Embodiment

Combustion Heating System 100

FIG. 1 is a perspective view that shows an external appearance of the combustion heating system 100 in the first embodiment. The combustion heating system 100 in the first embodiment is a premixed-type in which town gas or the like and air that serves as the oxidant gas for combustion are mixed prior to being supplied to the body container. However, the combustion heating system 100 is not limited to a certain case, and may also be a diffusion-type that performs so-called diffusion combustion.

As shown in FIG. 1, in the combustion heating system 100, a plurality (two in FIG. 1) of combustion heaters 110 are arranged side by side and connected, and upon receiving a supply of a mixed gas (hereinbelow called "fuel gas") consisting of town gas or the like and air, the fuel gas combusts at the respective combustion heaters 110, whereby they are heated. In the combustion heating system 100, the exhaust gas that is produced by that combustion is collected.

Figure 2:
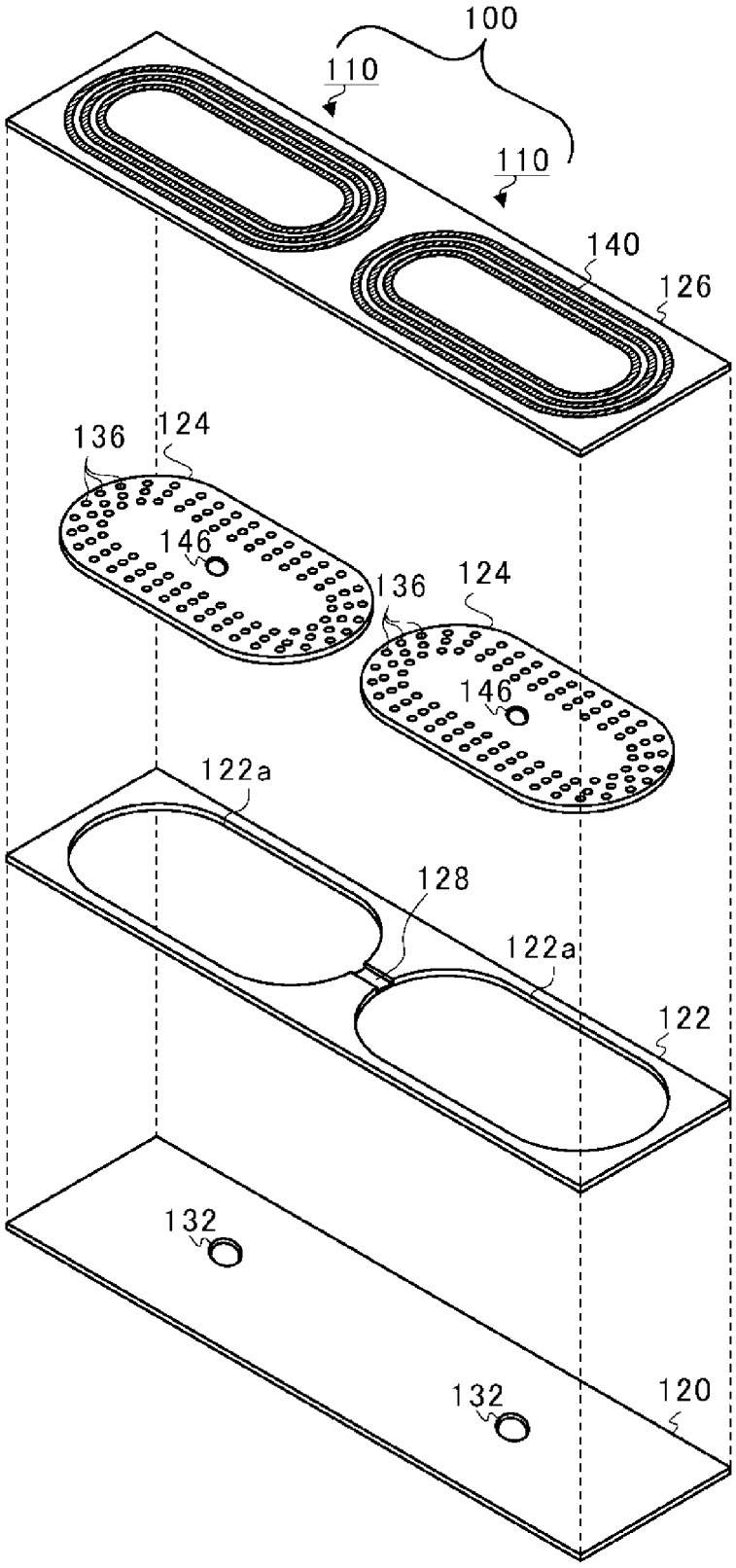
FIG. 2 is a drawing for describing the structure of the combustion heating system in the first embodiment of the present invention.

FIG. 2 is a drawing for describing the structure of the combustion heating system 100 in the first embodiment of the present invention. As shown in FIG. 2, the combustion heating system 100 is provided with a placement plate 120, an outer wall 122, a partitioning plate 124, and a heating plate 126.

The placement plate 120 is a plate-shaped member that is formed by a material with high thermal resistance and oxidation resistance, for example, stainless steel (SUS: Stainless Used Steel) or a material with low thermal conductivity.

The outer wall 122 is constituted by a thin plate-shaped member that has an outer shape in which the outer circumferential surface thereof is flush with the outer circumferential surface of the placement plate 120, and is laminated on the placement plate 120 as illustrated. In this outer wall 122, two holes 122*a* (through-holes) that penetrate in the thickness direction (the lamination direction of the outer wall 122 and the placement plate 120) and whose inner circumference has a track shape (a shape consisting of two approximately parallel linear portions and two curves (semicircles) that connect the end portions of the two linear portions) are provided.

Similarly to the placement plate 120, the partitioning plate 124 is formed by a material with high thermal resistance and oxidation resistance, for example, stainless steel, or a material with high thermal conductivity, such as brass or the like. The partitioning plate 124 is a thin plate-shaped member that has an outer shape that fits in the inner circumferential surface of the hole 122*a* of the outer wall 122. Accordingly, the partitioning plate 124 is arranged in an approximately parallel manner with the placement plate 120 on the inner side of the outer wall 122 by being fitted in the hole 122*a* of the outer wall 122.

The heating plate 126, similarly to the placement plate 120, is a thin plate-shaped member that is formed by a material with high thermal resistance and oxidation resistance, for example, stainless steel, or a material with high thermal conductivity, such as brass or the like.

The heating plate 126 has an outer shape such that the outer circumferential surface thereof and the outer circumferential surface of the placement plate 120 and the outer wall 122 become flush, and is laminated on the outer wall 122 and the partitioning plates 124. At this time, the heating plate 126 and the placement plate 120 are oppositely arranged in a substantially mutually parallel manner (virtually parallel in order to cause super-enthalpy combustion in the present embodiment). Also, the outer wall 122 is disposed following the outer circumference of the heating plate 126 and the placement plate 120, and the partitioning plates 124 are disposed opposite the heating plate 126 and the placement plate 120 inside the space enclosed by the heating plate 126, the placement plate 120, and the outer wall 122.

If gaps are formed between the placement plate 120, the partitioning plates 124 and the heating plate 126, they may be oppositely arranged in an inclined manner. Also, there is no restriction on the thickness of the placement plate 120, the partitioning plates 124 and the heating plate 126, and moreover they are not limited to flat plates, and may also be formed so that the thickness varies.

In this way, the body container of the combustion heating system 100 is constituted by blocking the top and bottom of the outer wall 122 with the heating plate 126 and the placement plate 120. Moreover, the combined surface area of the top and bottom wall surfaces (the outer surfaces of the heating plate 126 and the placement plate 120) is greater than the surface area of the outer surface of the outer wall 122. That is to say, the top and bottom wall surfaces occupy the majority of the outer surface of the body container.

Also, the combustion heating system 100 is constituted by connecting two combustion heaters 110 that are arranged side by side, and at the connection region between both combustion heaters 110, a flame transfer portion 128 that is continuous with a sealed space in the connected combustion heaters 110 is formed. However, although referred to as a sealed space, when used in a gas, it is not always necessary to completely seal it. In the combustion heating system 100 of the present embodiment, due to a single ignition by an ignition device such as an igniter (not illustrated), a flame spreads to the combustion heaters 110 that are connected through the flame transfer portion 128 and is ignited. As described above, two combustion heaters 110 are provided in the combustion heating system 100, but since the two combustion heaters 110 have the same constitution, hereinbelow one combustion heater 110 shall be described.

Figure 3:
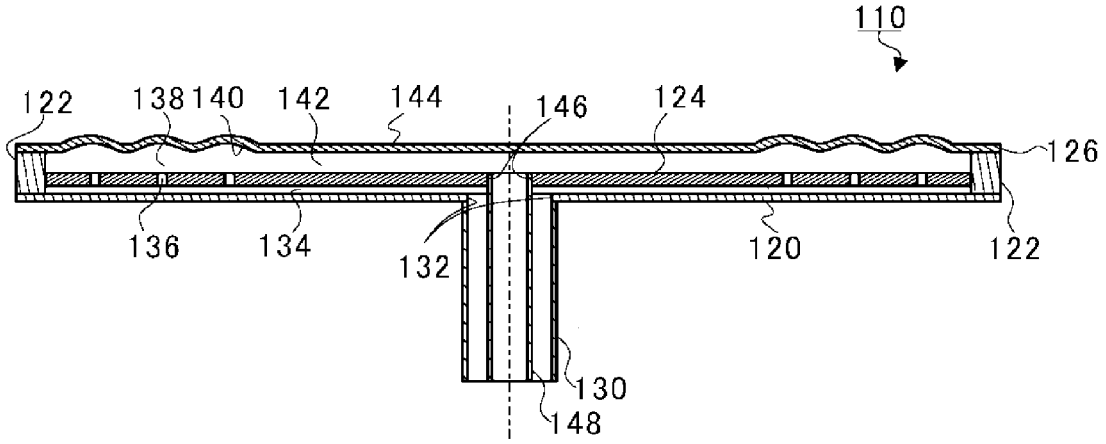
FIG. 3 is a cross-sectional view along the line of FIG. 1.

FIG. 3 is a cross-sectional view along the line of FIG. 1. As shown in FIG. 3, in the placement plate 120, a in-flow hole 132 that penetrates in the thickness direction is provided at the center portion of the combustion heater 110. A first pipe portion 130 through which fuel gas flows is connected to this in-flow hole 132, and fuel gas is guided into the body container of the combustion heater 110 via the in-flow hole 132.

Within the body container, a lead-in portion 134 and a lead-out portion 142 are adjacently formed by being partitioned by the partitioning plate 124. The positional relation of the partitioning plate 124, the lead-in portion 134, and the lead-out portion 142 shall be described below.

The lead-in portion 134 is formed by the gap between the placement plate 120 and the partitioning plate 124, and guides the fuel gas that has flowed in from the in-flow hole 132 in a radial manner to a combustion chamber 138.

A linking portion 136 is one or a plurality of through-holes provided in the partitioning plate 124 in the present embodiment. The linking portion 136 links the lead-in portion 134 and the lead-out portion 142.

The combustion chamber 138 is arranged in a space that is enclosed by the placement plate 120, the heating plate 126, and the outer wall 122. Also, the combustion chamber 138 is arranged on the lead-out portion 142 in the vicinity of the linking portion 136. The ignition device (not illustrated) is provided at an arbitrary position of the combustion chamber 138. Also, in the combustion chamber 138, fuel gas that is introduced from the lead-in portion 134 combusts, and the exhaust gas that is produced by this combustion is led out toward the lead-out portion 142.

A flame-stabilization portion 140 is provided in the combustion chamber 138, and maintains the combustion of the fuel gas in the combustion chamber 138. In the present embodiment, the flame-stabilization portion 140 is a concavity that is provided at a position in the heating plate 126 facing the linking portion 136.

Figure 4A:
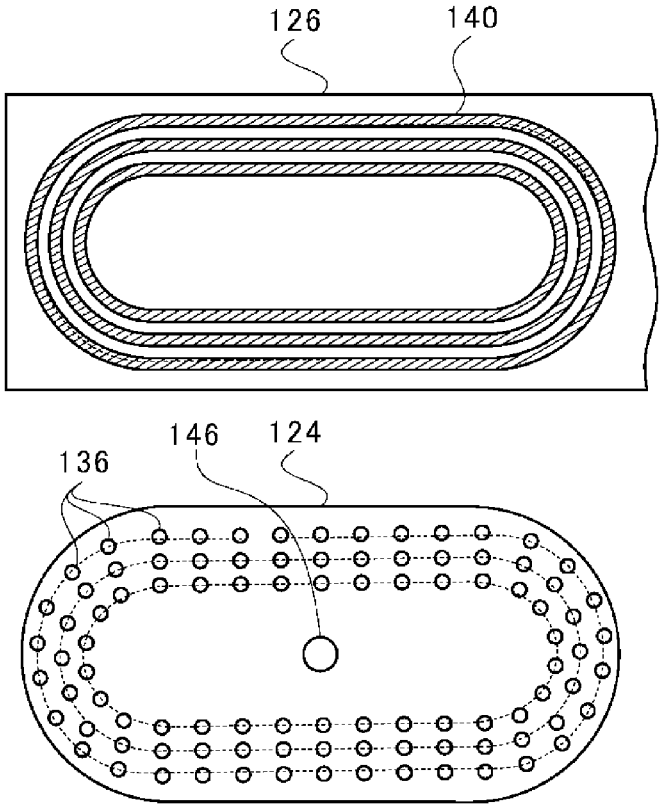
FIG. 4A is a drawing for describing the linking portion and the flame-stabilization portion.
Figure 4B:
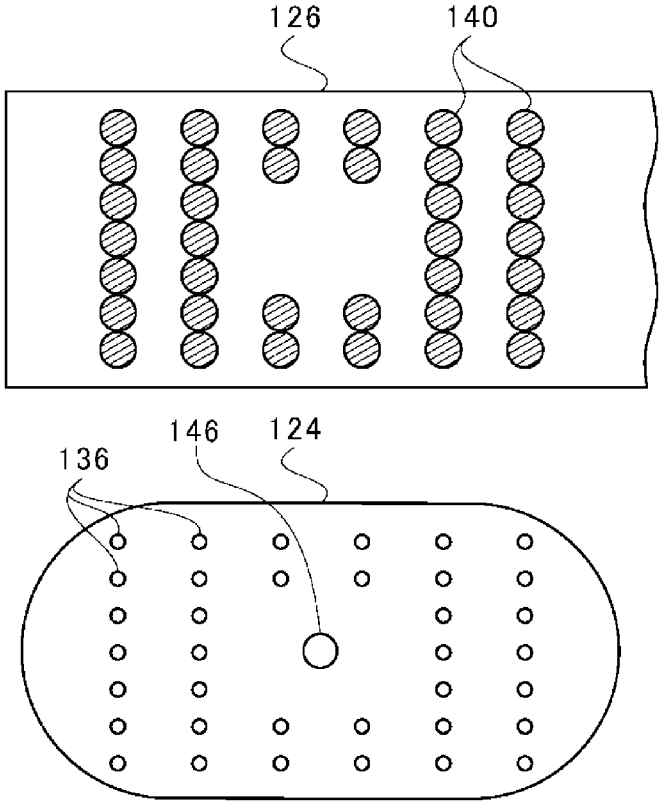
FIG. 4B is a drawing for describing the linking portion and the flame-stabilization portion.

FIG. 4A and FIG. 4B are drawings for describing the linking portion 136 and the flame-stabilization portion 140. FIG. 4A and FIG. 4B show front views of the heating plate 126 and the partitioning plate 124, with the respective opposing surfaces of the heating plate 126 and the partitioning plate 124 facing the front. The flame-stabilization portion 140 that is a concavity (shown by the hatching) provided in the heating plate 126 is for example formed in a track shape that resembles the outer shape of the partitioning plate 124 as shown in FIG. 4A. Also, the linking portions 136 are also disposed in a track shape (in FIG. 4A, virtual lines that connect the centers of the linking portions 136 are shown by broken lines) so as to face the flame-stabilization portions 140.

Moreover, the positions at which the linking portions 136 are disposed are not limited to a track shape, and as shown in FIG. 4B, they may also be arranged so as to form a row in the partitioning plate 124. In this case, the flame-stabilization portion 140 may be a plurality of circular concavities that are provided at positions facing the linking portions 136. Also, the linking portions 136 and the flame-stabilization portions 140 may be disposed in concentric circles, or at arbitrary positions.

Also, as shown in FIG. 3, the lead-out portion 142 is formed by a gap between the heating plate 126 and the partitioning plate 124, and gathers the exhaust gas that is produced by the combustion in the combustion chamber 138 at the center portion of the combustion heater 110.

As described above, in the body container, since the lead-in portion 134 and the lead-out portion 142 are adjacently formed, it is possible to transfer the heat of the exhaust gas to the fuel gas through the partitioning plate 124, and thereby preheat the fuel gas.

A radiation surface 144 is a surface on the external side of the heating plate 126, and is heated by the exhaust gas that flows through the lead-out portion 142 and the combustion in the combustion chamber 138, and transmits the radiation heat to an object to be fired.

An exhaust hole 146 that penetrates the center of the combustion heater 110 in the thickness direction is provided in the partitioning plate 124. A second pipe portion 148 is fitted in the inner circumferential portion of this exhaust hole 146. The exhaust gas, after heating the radiation surface 144, is lead out to the outside of the combustion heater 110 via the exhaust hole 146.

The second pipe portion 148 is arranged inside of the first pipe portion 130. That is to say, the first pipe portion 130 and the second pipe portion 148 form a double pipe. Also, the second pipe portion 148 has a function of transmitting the heat of the exhaust gas to the fuel gas that flows through the first pipe portion 130.

Here, the region (edge portion) of the placement plate 120 where the in-flow hole 132 is formed is fixed to the end portion of the first pipe portion 130, and the exhaust hole 146 of the partitioning plate 124 is fixed to the distal end of the second pipe portion 148 that protrudes out farther than the first pipe portion 130, and the placement plate 120 and the partitioning plate 124 are separated by the difference between the distal end of the first pipe portion 130 and the distal end of the second pipe portion 148.

Note that in the present embodiment, the in-flow hole 132 is provided in the placement plate 120, and the exhaust hole 146 is provided in the partitioning plate 124, but the in-flow hole 132 may be provided in the partitioning plate 124, and the exhaust hole 146 may be provided in the heating plate 126. In this case, the first pipe portion 130 and the second pipe portion 148 are inserted from the heating plate 126 into the lead-in portion 134 and the lead-out portion 142, and the first pipe portion 130 may be arranged within the second pipe portion 148. Also, the first pipe portion 130 and the second pipe portion 148 may be individually provided, and in this case, the in-flow hole 132 may be arranged at either the placement plate 120 or the partitioning plate 124, and the exhaust hole 146 may be arranged at either the heating plate 126 or the partitioning plate 124.

Figure 5:
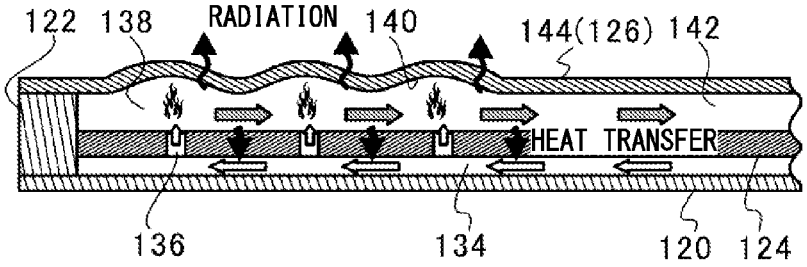
FIG. 5 is a partially enlarged view of FIG. 3.

Next, the flow of the fuel gas and the exhaust gas shall be described in concrete terms. FIG. 5 is a partially enlarged view of FIG. 3. FIG. 5 shows a partial enlargement of the left side of FIG. 3. In FIG. 5, the outlined arrows show the flow of the fuel gas, the arrows filled in with gray show the flow of the exhaust gas, and the arrows filled in with black show the movement of heat. When the fuel gas is introduced to the first pipe portion 130, the fuel gas flows in from the in-flow hole 132 to the lead-in portion 134, and flows toward the linking portions 136 while spreading out in a radial pattern in the horizontal direction. Then, the fuel gas, by passing through the linking portions 136, collides with the flame-stabilization portion 140 of the combustion chamber 138, and the flow rate decreases (is retained).

The fuel gas, after combustion by the flame that is ignited in the combustion chamber 138, becomes high-temperature exhaust gas, and the exhaust gas, after transmitting its heat to the radiation surface 144 of the heating plate 126 byin-flowg through the lead-out portion 142, passes through the exhaust hole 146 to be led out from the second pipe portion 148 to the outside.

The partitioning plate 124 is formed by a material that conducts heat comparatively easily, and the heat of the exhaust gas that passes through the lead-out portion 142 is conveyed to the fuel gas that passes through the lead-in portion 134 via the partitioning plate 124. That is to say, the exhaust gas that flows through the lead-out portion 142 and the fuel gas that flows through the lead-in portion 134 become counter flows sandwiching the partitioning plate 124. Accordingly, it becomes possible to effectively preheat the fuel gas with the heat of the exhaust gas, and it is possible to obtain a high thermal efficiency. Due to the so-called super-enthalpy combustion that combusts the fuel gas after preheating it in this way, it is possible to stabilize the combustion of fuel gas, and suppress to an extremely low concentration the concentration of CO (carbon monoxide) that is generated by incomplete combustion.

Also, the combustion heater 110 of the present embodiment is provided with the flame-stabilization portion 140 that consists of a concavity in the heating plate 126, and when the fuel gas is made to collide with this concavity, the fuel gas is hindered from diffusing compared to the case of colliding with a flat surface. Accordingly, it is possible to generate retention in the fuel gas, and so stabilizing the flame becomes possible. Accordingly, even if the combustion chamber 138 is provided offset from the outer wall 122, it is possible to stabilize the flame, and the degree of freedom of placement of the combustion chamber 138, that is to say, the degree of freedom of the design of the combustion heater 110, is high. Then, as in the present embodiment, if the position of the linking portion 136 and the combustion chamber 138 are moved away from the outer wall 122, heat dissipation from the outer wall 122 is suppressed, and so it is possible to raise the thermal efficiency.

Also, according to the combustion heater 110 of the present embodiment, since it is possible to perform flame stabilization with the simple constitution of providing a concavity in the heating plate 126, there is no requirement for a particular manufacturing cost for the sake of flame stabilization. Moreover, the combustion heater 110 is able to absorb thermal expansion with the concavity, and the radiation surface area increases. Accordingly, the contact surface area with the exhaust gas increases, the efficiency of heat transfer from the exhaust gas to the heating plate 126 improves, and it is possible to raise the radiant efficiency.

Also, by making the linking portions 136 of the combustion heater 110 be through-holes, it is possible to create the linking portions 136 with the simple process of punching holes in the partitioning plate 124, and so it is possible to lower the manufacturing cost. Moreover, by adopting a constitution that provides a plurality of the linking portions 136, a plurality of the flames that heat the radiation surface 144 are formed. For that reason, the combustion heater 110 can make the heating of the radiation surface 144 uniform.

Second Embodiment

Next, a flame-stabilization portion 240 in a second embodiment shall be described. In the second embodiment, since the flame-stabilization portion 240 differs from that of the aforementioned first embodiment, here descriptions of the constitutions that are the same as the aforementioned first embodiment shall be omitted, and only the flame-stabilization portion 240 with the differing constitution shall be described.

Figure 6:
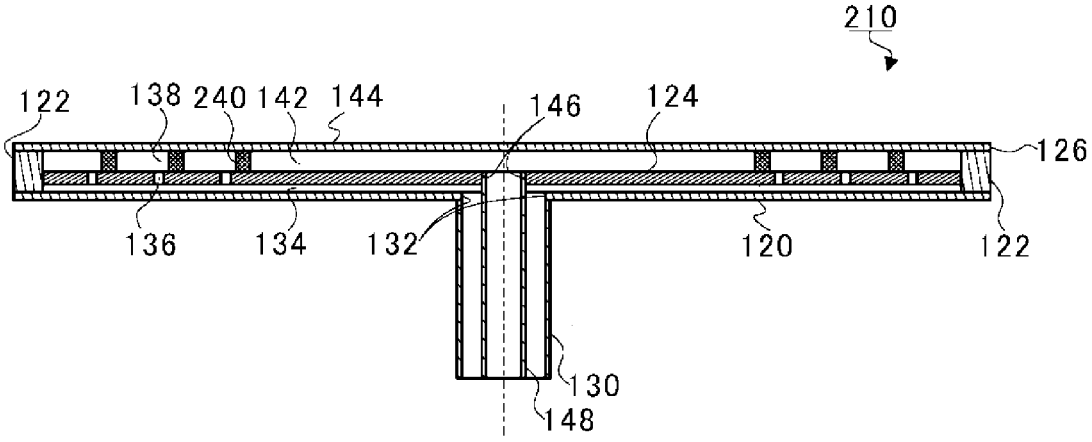
FIG. 6 is a drawing for describing a combustion heater in the second embodiment.

FIG. 6 is a drawing for describing a combustion heater 210 in the second embodiment. As shown in FIG. 6, the flame-stabilization portion 240 of the present embodiment is constituted by including a catalyst such as platinum or vanadium. In this way, with a constitution that disposes a catalyst in the combustion chamber 138, combustion in the combustion heater 210 stabilizes, and it is possible to expand the density and temperature range of the fuel gas that can be combusted.

Also, in the present embodiment, it is possible to realize the same operation and effect as the abovementioned first embodiment. That is to say, the combustion heater 210 is provided with the flame-stabilization portion 240, and the degree of freedom of placement of the combustion chamber 138 is high. For that reason, for example, it is possible to arrange the positions of the linking portions 136 and the combustion chamber 138 spaced apart from the outer wall 122, and it is possible to inhibit heat dissipation from the outer wall 122, and thereby raise the thermal efficiency.

Third Embodiment

Next, a flame-stabilization portion 340 in the third embodiment shall be described. In the third embodiment, since the flame-stabilization portion 340 differs from that of the aforementioned first embodiment, here descriptions of the constitutions that are the same as the aforementioned first embodiment shall be omitted, and only the flame-stabilization portion 340 with the differing constitution shall be described.

Figure 7:
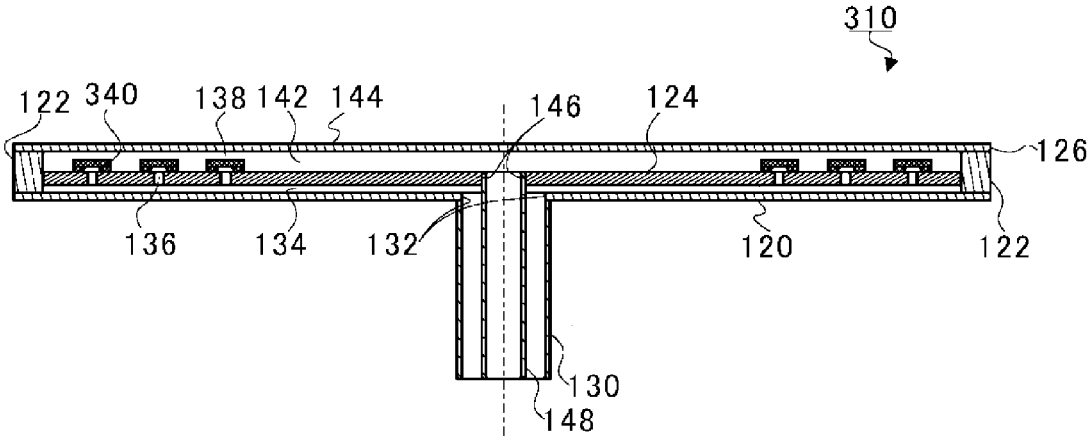
FIG. 7 is a drawing for describing a combustion heater in the third embodiment of the present invention.

FIG. 7 is a drawing for describing a combustion heater 310 in the third embodiment. As shown in FIG. 7, the flame-stabilization portion 340 of the present embodiment is constituted by including a porous body. The porous body consists of a combination of, for example, metal knit, sintered metal, ceramic, wire netting, punching metal, corrugated plate or the like. With a constitution that disposes the porous body in the combustion chamber 138, the flame stability of the combustion heater 110 increases, and so the combustion stabilizes.

Also, in the present embodiment, it is possible to realize the same operation and effect as the aforementioned first embodiment.

Fourth Embodiment

Next, a linking portion 436 in the fourth embodiment shall be described. In the fourth embodiment, since the linking portion 436 differs from that of the aforementioned first embodiment, descriptions of the constitutions that are the same as the aforementioned first embodiment shall be omitted here, and only the linking portion 436 with the differing constitution shall be described.

Figure 8:
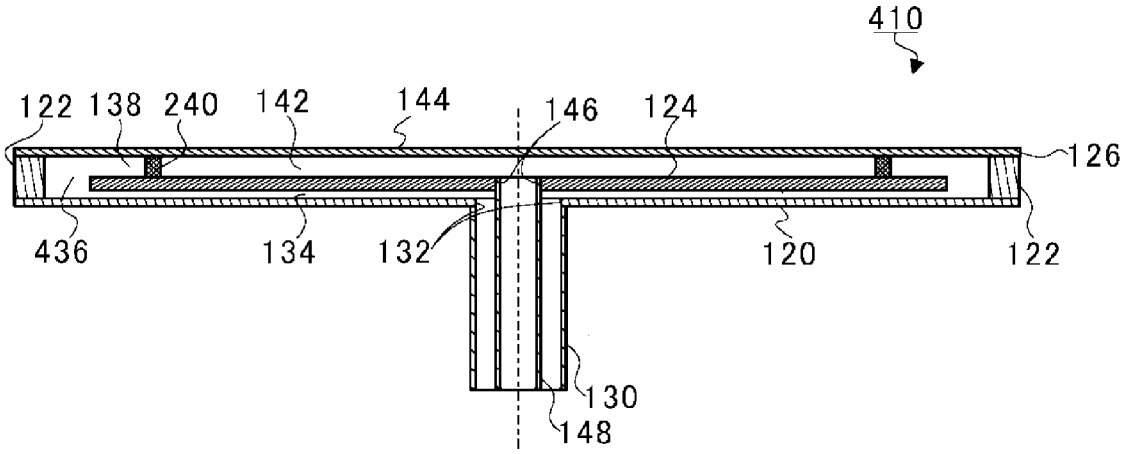
FIG. 8 is a drawing for describing a combustion heater in the fourth embodiment of the present invention.

FIG. 8 is a drawing for describing the combustion heater 410 in the fourth embodiment. As shown in FIG. 8, in the present embodiment, a gap is provided between the partitioning plate 124 and the outer wall 122, and is made to serve as the linking portion 436. In this case, by providing a catalyst or by providing a porous body as the flame-stabilization portion 240 in the manner of the present embodiment, it is possible to move the arrangement of the combustion chamber 138 away from the outer wall 122, and toward the exhaust hole 146. In this case, since backfiring is inhibited by the flame-stabilization portion 240, there is no need for a constitution such as a throttle for backfire prevention.

Also, for example a projection portion that narrows the flow passage of the lead-out portion 142 may be provided at the outer wall 122 side of the partitioning plate 124, beyond combustion chamber 138. With this constitution, retention occurs on the combustion chamber 138 side of the projection portion due to the fuel gas going around the projection portion and the flame stability further increases.

Also, in the present embodiment, it is possible to realize the same operation and effect as the aforementioned first embodiment.

Hereinabove, preferred embodiments of the present invention were described while referring to the attached drawings, but it goes without saying that the present invention is not limited to the embodiments. It is clear that a person skilled in the art could conceive various modifications and amendments within the scope disclosed in the claims, and they are understood to naturally belong to the technical scope of the present invention.

For example, in the aforementioned embodiments, the descriptions were given for the case of constituting the flame-stabilization portions with any of a concavity, a porous body, and a catalyst, but the flame-stabilization portions may also include a plurality among a concavity, a porous body, and a catalyst. Also, the constitution of the flame-stabilization portion is not limited to a concavity, a porous body, and a catalyst. In any case, the flame-stabilization portion should be a constitution that enables flame-stabilization by causing the flow of fuel gas in the combustion chamber to stagnate.

Also, in the aforementioned embodiments, the combustion heating system 100 in which two combustion heaters 110 are provided side by side was given as an example, but the combustion heater 110 may also be used alone without the combustion heating system 100.

INDUSTRIAL APPLICABILITY

The present invention can be utilized in a combustion heater that heats an object to be fired by burning fuel.

DESCRIPTION OF THE REFERENCE NUMERALS

110: combustion heater
120: placement plate
122: outer wall
124: partitioning plate
126: heating plate
134: lead-in portion
136, 436: linking portion
138: combustion chamber
140, 240, 340: flame-stabilization portion
142: lead-out portion

The invention claimed is:

1. A combustion heater comprising:

a heating plate;

a placement plate disposed opposite the heating plate;

an outer wall provided around the outer circumference of the heating plate and the placement plate;

a partitioning plate that is disposed opposite the heating plate and the placement plate inside a space enclosed by the heating plate, the placement plate, and the outer wall, that forms a lead-in portion by a gap with the placement plate, and that forms a lead-out portion by a gap with the heating plate;

a linking portion that links the lead-in portion and the lead-out portion;

a combustion chamber that combusts fuel gas at the lead-out portion near the linking portion; and a flame-stabilization portion that is provided in the combustion chamber and that maintains the combustion of the fuel gas in the combustion chamber, wherein the flame-stabilization portion includes a concavity that is provided at a position of the heating plate opposite the linking portion.

2. The combustion heater according to claim 1, wherein the linking portion is one or a plurality of through-holes provided in the partitioning plate.

3. The combustion heater according to claim 2, wherein the flame-stabilization portion includes a catalyst.

4. The combustion heater according to claim 3, wherein the flame-stabilization portion includes a porous body.

5. The combustion heater according to claim 2, wherein the flame-stabilization portion includes a porous body.

6. The combustion heater according to claim 1, wherein the flame-stabilization portion includes a catalyst.

7. The combustion heater according to claim 6, wherein the flame-stabilization portion includes a porous body.

8. The combustion heater according to claim 1, wherein the flame-stabilization portion includes a porous body.

* * * * *